United States Patent [19]

Krogh

[11] Patent Number: 4,502,237

[45] Date of Patent: Mar. 5, 1985

[54] MAGAZINE FOLLOWER FOR AUTOMATIC PISTOLS

[75] Inventor: Paul M. Krogh, Burbank, Calif.

[73] Assignee: Ken-Air, Inc., Sun Valley, Calif.

[21] Appl. No.: 446,179

[22] Filed: Dec. 2, 1982

[51] Int. Cl.[3] ..... F41C 25/02

[52] U.S. Cl. ..... 42/50

[58] Field of Search ..... 42/50, 7

[56] References Cited

U.S. PATENT DOCUMENTS 1,245,499 11/1917 Orme ..... 42/50
1,571,776 2/1926 Glaser ..... 42/50
1,797,951 3/1931 Gaidos ..... 42/50
2,944,357 7/1960 Smith et al. ..... 42/50

*Primary Examiner*—Charles T. Jordan
*Attorney, Agent, or Firm*—Baker, Maxham, Callan & Jester

[57] ABSTRACT

A follower for the magazine of an automatic pistol includes front and back generally parallel guides that extend downward for engagement with the front and back walls of the magazine tube and is proportioned to be insertable and removable through the top of the magazine and includes a slide top shoulder.

7 Claims, 7 Drawing Figures

MAGAZINE FOLLOWER FOR AUTOMATIC PISTOLS

BACKGROUND OF THE INVENTION

The present invention relates to cartridge magazines for automatic weapons and pertains particularly to an improved follower for a fixed base cartridge tube.

Many automatic and semi-automatic weapons utilize a cartridge magazine tube that is of a generally square box-like configuration rounded at the front end to conform to the configuration of the nose of the bullets in the cartridge and includes an opening at the top with a follower and a spring for biasing the follower upward to force cartridges to the open end for semi-automatic loading by the weapon. Some magazines such as the Colt-type magazine for automatic pistols such as the military Colt 45 are constructed with a fixed nonremovable base and a follower that is insertable through the opening in the top of the magazine. Followers for this type of fixed base magazines have not had a front guide because of the necessity for keeping the follower sufficiently small in certain dimensions that it can be inserted and removed from the top opening of the magazine.

Some magazines are provided with followers which have front and rear guides which engage the front and rear walls of the magazine for a smooth guidance of the follower as it forces the cartridges to the open end of the magazine. The combination of front and rear guides provide desirable smoothness of function and consequent steadiness and uniformity of feed. The entire feed mechanism of an automatic pistol depends on smooth functioning, high quality magazines. Such magazines having double guide followers, however, must have a removable bottom in order that the follower can be removed for cleaning and for repair, or replacement of the follower or spring, etc.

The Colt-type follower as illustrated in FIGS. 1 and 2 of the drawings has a rear guide but no front guide because it must be inserted and removed through the top opening of the magazine. The Colt-type automatic pistol is standard U.S. government issue, of which about four (4) million have been manufactured since 1911, and of which about 500,000 are presently in active service. The Colt-type magazine with the fixed nonremovable base is a rugged high strength magazine due to the fixed base and can hold seven cartridges as opposed to six cartridges for some replacement magazines of the removable base-type. The Colt-type follower for the magazine having a single guide at the back end thereof is subject to tipping forward and jamming on the edge of the magazine as shown in FIG. 2 when attempting to insert the first cartridge in the magazine. These magazine followers also have a tendency to wedge and stick in the magazine tube. Such followers also do not function as smoothly as the double guided-type. Smooth operating magazines are a necessity for the reliable functioning of automatic pistols.

Heretofore, no double guide followers have been available for insertion into the open end of the fixed base-type magazines.

It is therefore desirable that a double guide follower be available which is insertable and removable from the open end of fixed base cartridge magazines.

SUMMARY AND OBJECTS OF THE INVENTION

It is therefore the primary object of the present invention to provide an improved magazine follower for fixed base cartridge magazines.

In accordance with the primary aspect of the present invention, a magazine follower for the cartridge magazine of an automatic piston includes front and back guide members defining parallel guiding surfaces engaging the front and back walls of the magazine for guiding the follower for smooth action within the magazine and is sized and shaped to be insertable and removable through the top cartridge opening in the magazine.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
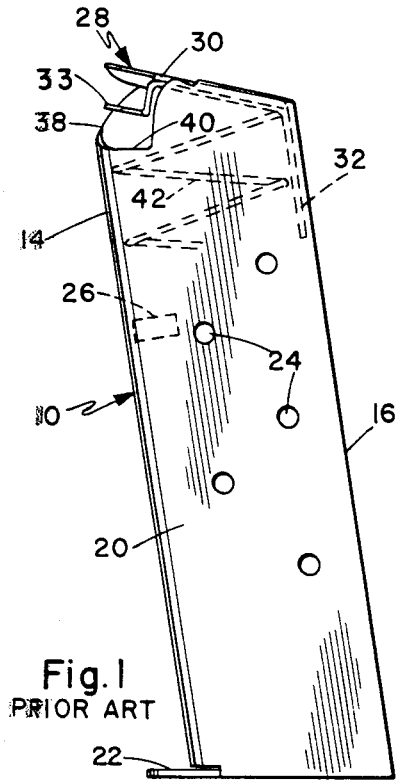
Fig. 1 PRIOR ART
FIG. 1 is a side elevation view of a typical magazine with a conventional type follower.
Figure 2:
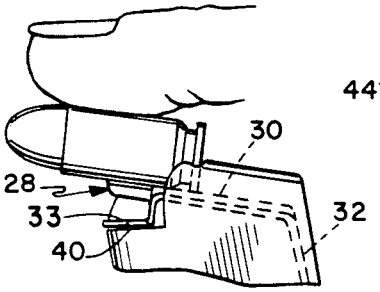
Fig. 2 PRIOR ART
FIG. 2 illustrates the insertion of the first cartridge in the magazine of FIG. 1.

Referring to FIGS. 1 and 2 of the drawings, a standard fixed base magazine of the type for a 45 caliber automatic pistol designated generally by the numeral 10 is drawn to scale, and includes a elongated generally rectangular tube constructed generally of a single piece of sheet metal shaped and formed to a configuration with a generally semi-cylindrical front wall 14, a generally flat back wall 16 and generally flat planar side walls 18 and 20.

The tube is shaped to have an open top having features that will be more specifically described and a fixed base or bottom 22 which is nonremovably fixed into position by welding, riveting and the like. The fixed base 22 provides a stronger, more rugged magazine, eliminating fastening or attachment devices as required on removable base-type magazines. The standard 45 Colt-type magazine holds seven cartridges as opposed to six cartridges for at least one model of a removable base replacement magazine that is available.

The magazine includes a plurality of aligned holes or bores 24 formed in the side walls of the tube for insertion of a pin to retain the follower spring in a retracted position and for inspection to allow the user to observe the number of rounds inserted. A magazine catch notch 26 is formed in the front right hand side (looking from back to front) of the magazine tube (FIG. 6) for engagement by the retaining or catch latch of the pistol. A conventional follower 28 of the type for such fixed based magazines is of a generally slant L-configuration having a support surface 30 for engaging the underside of the cartridge as shown in FIG. 2 and includes a back guide leg 32 extending downward at an angle for engagement and guiding along the back wall 16 of the tube. A slide stop 33 engaging surface steps downward from the front left edge or side of the follower 30. This slide stop surface engages the pistol slide stop which retains the pistol slide open after the last round has been ejected. The follower is supported in the magazine by the upper end of a follower spring 42.

Figure 4:
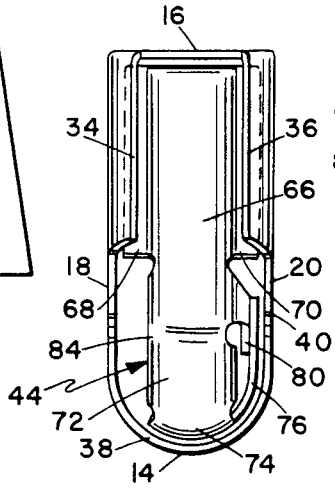
FIG. 4 is a top plan view of the magazine and follower of FIG. 3.
Figure 5:
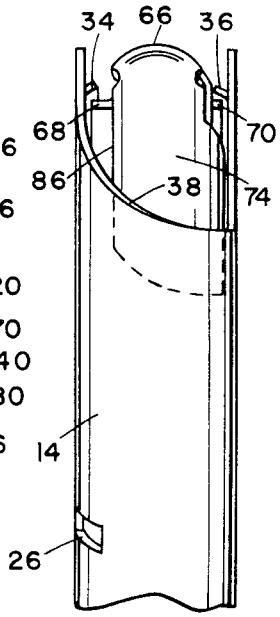
FIG. 5 is a front view of the magazine and follower of FIG. 3.

The open top of the magazine includes retaining lips 34 and 36 which curve over from the side walls 18 and 20 at a slight angle upward and inward and extend approximately to the halfway mark toward the front wall 14 of the tube. This lip overhang 34, 36 engages the edges of the follower 30 for retaining the follower in the housing as well as engages the upper surfaces of the cartridges which are forced downward under the lip and back for retention within the magazine. The forward portion of the housing is open with the front wall sloping downward from left to right (as viewed from the front) as shown in FIGS. 4 and 5 providing a notched opening with the curved upper forward edge 38 sloping down to a generally flat upper edge 40 at the right edge. This opening in the forward wall provides clearance to permit the cartridges to be inserted and to slide out of the magazine with the notch at the side defined by edge 40 permitting the engagement of the slide catch by the catch member 33 for retaining the slide in the open position when the last cartridge has been fed from the magazine into the chamber and fired.

The follower 30 of a conventional type is removable and insertable into the magazine from the top through the above described opening. The structure and configuration of the follower has been designed for this purpose and is accomplished by biasing the follower spring 42 downward in the magazine tube and pinned in place by a pin or nail inserted across the tube through the bores or holes 24. This removes the pressure of the spring on the follower permitting it to slide to the top and tip forward with the forward end moving out of the top front of the tube, thus removing the follower therefrom. The follower may then be repaired and replaced in the tube and the tube cleaned or spring replaced as needed. The follower spring 42 may be similarly removed from the top through the top opening of the magazine tube.

One problem with the conventional follower 30 as illustrated is best appreciated from viewing FIG. 2 wherein it will be seen that the follower has a single guide member 32 depending downward from the back end thereof. In loading a cartridge into the magazine, the cartridge is positioned with the back end of the cartridge forward of the forward end of lips 34 and 36 pressing downwardly on the forward end of the follower, pushing it downward against spring 42 until the upper edge of the cartridge clears the lips 34 and 36 allowing it to be slipped backward against the back wall 16 of the magazine. When pressing downward on the forward end of the follower, care must be taken to prevent the follower from tipping forward and engaging the front surface of edge 38, thus jamming and thereby preventing the follower from moving down to load the first cartridge, such jamming can critically slow the loading process. The guide configuration of this follower, however, has in the past been dictated by the requirement that it be insertable and removable from the top opening of the magazine tube.

Figure 3:
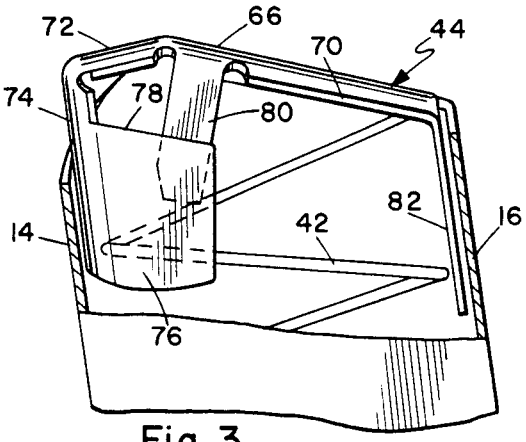
FIG. 3 is an enlarged side elevation view partially cut away showing the improved follower in the magazine.
Figure 6:
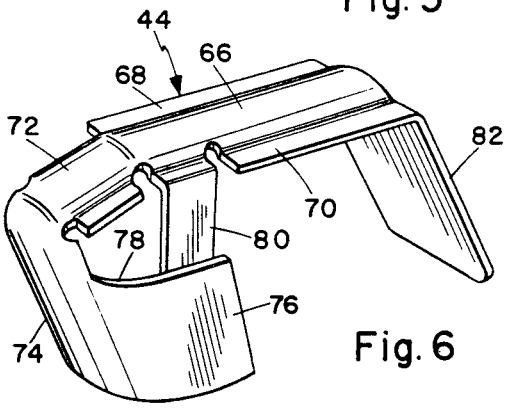
FIG. 6 is a perspective view of the improved follower.

The present invention as best illustrated in FIGS. 3 through 6, at two times actual scale, comprises a follower designated generally by the numeral 44 which, as will be appreciated from the following description, includes front and rear guides and is sized and shaped to be insertable and removable through the top opening of the magazine tube. This follower is preferably cut and shaped (e.g. by stamping) from a unitary piece of sheet metal, and shaped as illustrated in FIGS. 3 and 6 to define a central connecting and support member with an upper semicylindrical support surface 66 for engaging a cartridge and including side or parallel lip engaging flanges or lips 68 and 70 for engaging the lips 34 and 36 at the top opening of the magazine tube. The central support or structure member includes a downwardly sloping front portion 72 sloping downward from the general slope or plane of the cartridge support surface 66 and connecting to a front guide 74, which has a generally semi-cylindrical curved front portion conforming to the curvature of the inner wall 14 and including a side skirt 76 with an upper edge 78 spaced downward from and extending generally parallel to support surface 66 forming the slide stop catch surface for the actuation of the pistol slide stop. A downwardly extending arm 80 extends from the side edge of the central connecting member down to and is connected to the inside surface of the skirt 76 such as by welding, brazing or the like (FIGS. 3 and 6). A back guide 82 having a generally flat rectangular configuration extends downward from the back end of the follower and has a generally flat configuration (FIG. 6) for engaging and guiding along the inside back wall 16 of the magazine tube.

As can be seen from FIGS. 4 and 5, the front left side of the follower (as viewed from the top and front as shown) is cut away defining edges 84 and 86 spaced from the side wall 18 of the magazine tube and extending forward of the lips 34 and 36 for clearance of the magazine retaining catch and to provide some further clearance to allow tipping of the follower past the lips for removal and reinsertion through the open top of the magazine tube.

The front guide surfaces 74 and 76 lend stability to the follower providing a smooth action as the follower moves up and down within the magazine for accepting cartridges as cartridges are loaded therein or for feeding cartridges as they are removed from the upper end of the magazine by the action of the pistol or the like. The forward guide 74 and skirt 76 extend down below and overlap the front wall edge 38 and thereby provide a full guidance of the follower from the very top down to the bottom of the magazine. This follower, with substantially equal length front and back guides 74 and 82 and insertable from the top, permits the use of fixed base magazine tubes to take advantage of the rugged and stable structure thereof.

Figure 7:
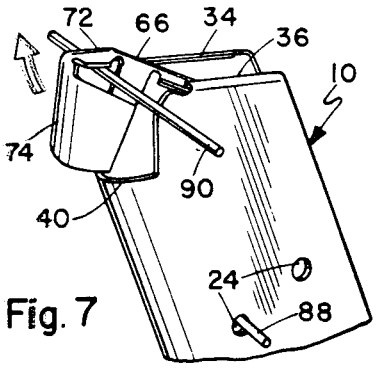
FIG. 7 illustrates the method of removing the follower from the magazine.

The follower is constructed such that it may be removed or inserted through the top opening (FIG. 7) by biasing the follower spring 42 downward as with the previous embodiment and retaining the spring in the downward position by a nail or pin 88 through one pair of aligned holes 24 of the magazine. The follower is then shaken to the top, tipped backward with the front supported by a nail or pin 90 and slipped through the opening in the front of the follower at the junction of the guide 74 and member 72 and the follower moved forward and pulled upward from the top front of the tube. Reinsertion of the follower in the tube is the reverse of the above described procedure as illustrated in FIG. 7.

It is apparent that numerous advantages of this follower exist over the prior art devices. The double guides provide a smoother operation guiding the follower with less chance of binding within the tube. The front and back guides also prevent the follower from tipping forward when the slide stop is engaged and also prevents the follower from tipping forward when loading the first round. The construction also allows a closer tolerance control of the follower width to prevent slide stop override. The front guide also prevents the possibility of the follower from moving forward and possibly damaging the feed ramp of the pistol during recoil.

The forward radius section of the follower guide 74 allows the follower to pivot in the tube without the spring to allow insertion and removal of the follower. Also the skirt 76 terminates short of the forward edge of the magazine catch slot. The length of the wide portion 66 of the follower is proportioned to allow the follower to be inserted through the top opening and turned at a backward angle under the lips and then rotated forward into place, while providing clearance for the magazine catch and adequate support under the feed lips. The front guide 74 is sized and shaped with a length (about 0.75 inches), a width (about 0.375 inches), and an overlap (about 0.225 inches) of front wall 14, with the lower edge thereof having substantially the same curvature as edge 38 to allow the above described insertion and removal as illustrated in FIG. 7.

While I have illustrated and described my invention by means of specific embodiments, it is to be understood that numerous changes and modifications may be made therein without departing from the spirit and scope of the invention as defined in the appended claims.

I claim:

1. A top insertable follower for a cartridge magazine, said follower comprising:

a generally horizontal cartridge engaging support surface having a front end and a rear end;

a rear guide extending downwardly from the rear end of said surface for engaging a rear wall of a magazine tube;

a front guide extending downwardly for engaging a front wall of a magazine and including a slide stop catch notch, said front guide having a length sufficient to extend beyond a cartridge opening in a front wall of a magazine for engaging a front wall of a magazine when said follower is in the uppermost position, said front guide includes a skirt extending around from the front along a side wall of a magazine and includes an upper surface defining said slide stop catch notch said follower being dimensioned for removal and insertion of said follower through an open top of a magazine.

2. The follower of claim 1 wherein said front guide terminates short of one side for clearing a magazine retainer catch.

3. The follower of claim 2 including an arm extending downward from one side of said support surface and connected to said skirt for structural support thereof.

4. The follower of claim 3 wherein said cartridge support surface terminates short of said front guide and is connected to said front guide by means of a downwardly sloping extension thereof.

5. The follower of claim 4 wherein said cartridge support surface has a semi-cylindrical configuration.

6. A top insertable and removable follower for a cartridge magazine, said follower comprising:

a generally horizontal cartridge engaging support surface;

a rear guide having a generally rectangular configuration extending downwardly from a rear end of said surface for engaging a rear wall of a magazine tube; and, a front guide extending downwardly from a forwardly extending extension of said support surface for engaging a front wall of a magazine and including a skirt extending around from the front guide along a side wall of a magazine and includes an upper surface defining a slide stop catch notch, said front guide having a length sufficient to extend beyond a cartridge opening in a front wall of a magazine for engaging a front wall of a magazine when said follower is in the uppermost position, an arm extending downward from one side of said support surface and connected to said skirt for structural support thereof, said follower being dimensioned for removal and insertion through an open top of a magazine.

7. The follower of claim 6 wherein said cartridge support surface has a semi-cylindrical configuration, terminates short of said front guide and is connected to said front guide by means of a downwardly sloping extension thereof.

* * * * *